United States Patent [19]

Wilson

[11] 4,300,268

[45] Nov. 17, 1981

[54] PAPER CLIPS

[76] Inventor: Michael A. Wilson, Rocky Mountain National Park, Estes Park, Colo. 80517

[21] Appl. No.: 158,236

[22] Filed: Jun. 10, 1980

[51] Int. Cl.[3] ..... A42F 1/02

[52] U.S. Cl. ..... 24/67 R; 24/67.9; 24/261 R; 24/DIG. 8

[58] Field of Search ..... 24/67.9, 67 R, 67.3, 24/67.5, 67.11, 261 R, DIG. 8, DIG. 9; D19/65; 211/11

[56] References Cited

U.S. PATENT DOCUMENTS

| | | | |
|---|---|---|---|
| 742,892 | 11/1903 | McGill | 24/261 R |
| 874,572 | 12/1907 | Curtis | 24/67.9 |
| 969,700 | 9/1910 | Hylkema | 24/67.9 |
| 1,167,734 | 1/1916 | Anderson | 24/261 R |
| 1,476,420 | 12/1923 | Romig | 24/67.9 |
| 1,551,467 | 8/1925 | Carousso | 24/261 R |
| 1,565,501 | 12/1925 | Robinson, Jr. | 24/67.9 |
| 1,600,748 | 9/1926 | Bader | 24/67.9 |
| 1,783,484 | 12/1930 | Ross | 24/67.9 |
| 1,914,816 | 6/1933 | Nielsen | 24/261 R |
| 2,051,174 | 8/1936 | Levigard | 24/67.9 |
| 2,116,238 | 5/1938 | Harvey | 24/261 R |
| 2,652,610 | 9/1953 | Cruce | 24/261 R |
| 2,781,566 | 2/1957 | Hammer | 24/261 R |
| 2,938,252 | 5/1960 | Scheemaeker | 24/67.9 |
| 3,123,924 | 3/1964 | Roberts | 24/67.9 |
| 3,225,469 | 12/1965 | Chase | 24/67.9 |
| 3,348,271 | 10/1967 | Miller | 24/67.9 |

FOREIGN PATENT DOCUMENTS

| | | | |
|---|---|---|---|
| 457163 | 1/1927 | Fed. Rep. of Germany | 24/261 R |
| 444860 | 5/1927 | Fed. Rep. of Germany | 24/261 R |
| 814290 | 7/1951 | Fed. Rep. of Germany | 24/67.9 |
| 9166 | of 1905 | United Kingdom | 24/261 R |

*Primary Examiner*—Victor N. Sakran
*Attorney, Agent, or Firm*—Hugh H. Drake

[57] ABSTRACT

A single paper clip is capable of separately holding two different sheafs of papers. It is formed of a continuous length of wire successively bent into a series of re-entrant loops interspersed with six legs. One sheaf of papers may be secured between a first and third loop, and a second sheaf is thereafter secured between a third and fifth loop.

7 Claims, 2 Drawing Figures

PAPER CLIPS

The present invention pertains to paper clips. More particularly, it relates to a paper clip that will separately hold two different separated sheafs of papers.

One of the most common devices used in an office and otherwise is the paper clip. In a usual form, it is made of a continuous length of wire looped re-entrantly three times, so as to define four parallel legs. The leg lengths are such that a third loop ordinarily is spaced slightly inside a first loop. In use, a plurality of sheets of papers, forming a sheaf, are secured together by engaging the first loop on one side of the sheaf and then sliding the clip into place as the other loop is caused to engage the opposite side of the sheaf.

A paper clip of the foregoing type is shown in U.S. Pat. No. 3,225,469-Chase. That patent goes further and teaches placement, on one outer-end loop, of a sleeve or sheaf that serves as an index tab. A longer sleeve, for carrying a marking or notation, is inserted over the first two legs of the same kind of paper clip in the disclosure of U.S. Pat. No. 1,476,420-Romig.

The very common form of clip first-mentioned above, that has four legs, permits easy insertion of the clip onto a sheaf of papers only from one end of its generally elongated conformation. The free ends of the wire facing the other end of the clip may make it somewhat difficult to insert that other end over the bundle of papers. Both of U.S. Pat. Nos. 1,565,501-Robinson, Jr. and 1,783,484-Ross teach the inclusion of one additional loop and leg so as to render the paper clip double-ended and permit easy insertion of the clip onto the sheaf of papers from either end of the clip. In Ross, the different conformations are nested one within another so as to lie in a common plane. In Robinson, on the other hand, certain of the legs lie on top of others of the legs and a central portion of the assembly is deformed so as to increase gripping action.

Believed to be representative of a widespread variety of the kinds of paper clips heretofore discussed are the following U.S. Pat. Nos: 742,892-McGill 874,572-Curtis 969,700-Hylkema 1,600,748-Bader 1,914,816-Nielsen 2,051,174-Levigard 2,781,566-Hammer 3,123,924-Roberts 3,348,271-Miller.

As a group, these patents feature the use of additional bends or nubs, additional legs spaced laterally to others of the legs or various deformations in order better to perform in terms of increased gripping pressure, ease of placement of the clip upon the sheaf of papers, ease of removal of the clip at a later time or cooperation with something additional such as an index tab.

In common to all of the foregoing prior art references is the concept of using a single paper clip to secure together one sheaf or bundle of sheets of paper. In U.S. Pat. No. 2,652,610-Cruce, it was recognized that it sometimes is desirable to associate into a single stack a plurality of sheafs of papers, the papers in each sheaf being individually secured together and the multiplicity of sheafs, in turn, being secured together. To that end, Cruce formed a hinge arrangement on the free ends of the initially-discussed basic-form of paper clip. That hinge was so formed that each individual clip, which held a single sheaf of papers, could be secured into the same kind of hinge on a next one of the clips that secured another sheaf of papers. In an illustrative example, the user, therefore, could separately secure together the sheafs of paper which comprised each of a succession of chapters of a book. Yet, all chapters are held together in a single overall bundle.

It is a general object of the present invention to provide a new and improved paper clip that is capable of taking advantage of the best features of the aforenoted prior art and yet which affords a new dimension in utility.

Another object of the present invention is to provide a new and improved paper clip which enables the separate securing of a plurality of sheafs of papers and yet which is only a one-piece device.

A further object of the present invention is to provide a new and improved paper clip which permits assembly together of multiple but separated sheafs of papers and which, nevertheless, may be fabricated as simply as are the most common of present-day paper clips.

A paper clip manufactured in accordance with the present invention is composed of a continuous length of wire multiply bent re-entrantly to define a plurality of loops formed to comprise a first leg of the wire continuing in a first direction from one end of the wire a first distance. A first re-entrant loop of the wire continues from that first leg into a second leg a second distance in a second direction opposite the first direction. A second re-entrant loop of the wire continues from the second leg and into a third leg continuing from a second loop a third distance but in the first direction. Then there is a third re-entrant loop of the wire which continues from the third leg into a fourth leg that continues a fourth distance in the second direction and into a fourth re-entrant loop which continues, still further, into a fifth leg of the wire a fifth distance in the first direction. A fifth re-entrant loop continues from the fifth leg into a sixth leg of the wire a sixth distance in the second direction.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements and in which:

Figure 1:
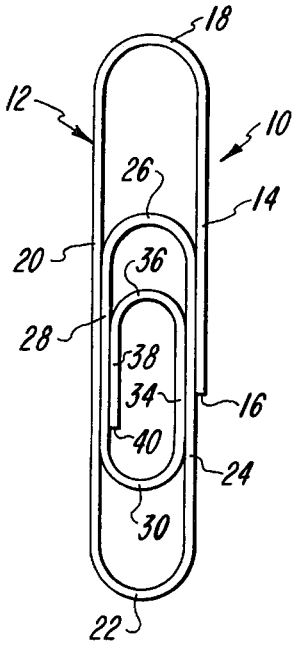
FIG. 1 is a plan view of a paper clip.
Figure 2:
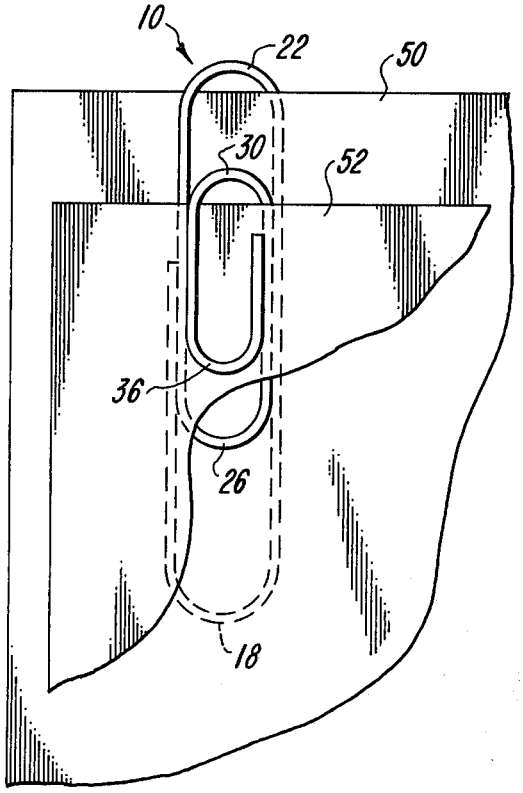
FIG. 2 is a fragmentary view of a paper clip holding a plurality of sheafs of paper.

A paper clip 10 is composed of a continuous length of wire 12 that, as shown in the drawings, is multiply bent re-entrantly to define a plurality of loops. In accordance with the fabrication of conventional paper clips, wire 12 is metallic and exhibits a degree of resiliency but yet is rather readily deformable, so as to accommodate the spreading of its parts to accept its receipt upon a sheaf of papers wider than, perhaps, the thickness of the sheaf of papers upon which the clip was intended to be received. Of course, the continued development of nonmetals useful for many different purposes, including those which exhibit resiliency, suggests that wire 12 may be made from other than a metal element.

In any case, there is a first leg 14 of wire 12 that continues in a first direction from one end 16 of the wire a first distance. A first re-entrant loop 18 continues from first leg 14. A second leg 20 continues from first loop 18 a second distance in a second direction that is opposite the first direction away from end 16.

A second re-entrant loop 22 continues from leg 20 into a third leg 24 a third distance in the same direction as leg 14. A third re-entrant loop 26 continues from leg 24 into a fourth leg 28 a fourth distance in the direction of leg 20. Thereafter, a fourth re-entrant loop 30 continues from leg 28 into a fifth leg 34 a fifth distance and in the same direction as original leg 14. A fifth re-entrant loop 36 then continues on around to that which in this case is a final leg 38 that continues a sixth distance in a direction of leg 20. Leg 38 terminates in the other end of wire 12 at 40.

As will be seen in the drawing, and as viewed in a direction transverse to the directions of the legs, legs 34 and 38 are nested within legs 24 and 28 and legs 24 and 28 are, in turn, nested within legs 14 and 20. At the same time, loops 26 and 36 are nested within loops 22 and 26. Moreover, the preferred form of paper clip 10 has all of the different legs and loops residing in a common plane.

It will be noted that the distance of extent of leg 20 is greater than that of leg 14, and the distance of extent of leg 24 is less than that of leg 20. At the same time, the distance of continuation of leg 28 is less than the similar distance of leg 24, and the distance of extent of leg 34 is still less than the distance spanned by leg 28. Moreover, in the version shown, the distance of extent of leg 38 is still less than the distance of extent of leg 34.

In the illustrated embodiment, all of legs 14, 20, 24, 28, 34 and 38 are parallel to one another. Accordingly, the illustrated form of paper clip very much resembles the common form of paper clip first mentioned in the introduction. However, that is not a necessary limitation. In essence, the clip would perform its new function the same even if the different legs were formed as to have either an inward or outward bow. For example, it would work the same if each of the space-opposed legs and their corresponding and intermediate loops formed a circle.

It will be noted that each of loops 18, 26 and 36 mutually are approximately concentric. Of course, there is not true concentricity in the illustrated version, because of the nesting in a common plane that results in change of radii. In the same vein, loops 22 and 30 also are approximately concentric.

In use, a first sheaf 50 of a plurality of papers may be inserted beneath loop 26 and on top of loop 18. That, of course, is in the manner of usage of the ordinary paper clip. Next, a second sheaf 52 of a plurality of sheets of paper may then be inserted between loops 26 and 36. That secures the second sheaf in the same manner as the first sheaf and also in the same manner as in use of the ordinary paper clip. Yet, the two sheafs are maintained separate while, at the same time, they are held in mutual association and in a common stack. Thus, a single one-piece paper clip serves to separately hold and yet mutually associates two different sheafs.

Of course, paper clip 10 could be used in a reverse direction. With a little manipulation by the fingertips of the user, its other end at loop 22 also can be made to separately hold two different sheafs of paper. Usage in that manner means the possibility of encountering friction against either one or both of free ends 16 and 40 of the wire.

On the other hand, such reversal of the clip desirably leaves loop 18 exposed above the papers for the purpose of hanging it from a hook, nail or the like.

If it would be necessary to use clip 10 in what might be called a double-ended manner, the prior art of Robinson or Ross, discussed in the introduction, may be adapted so as to include one more loop beyond end 40 as herein specifically shown. The addition of such a further loop helps to insure that the clip can be removed as easily as it can be inserted without tearing into a sheet of paper.

Having understood that more re-entrant convolutions permit the acceptance of multiple sheafs of papers, it will be appreciated that the approach described might be continued into the formation of still additional loops and legs so that three, four or however many additional sheafs might be associated and yet held by a single clip. Of course, that soon gets into a clip which becomes extremely bulky in either or both of the length or width direction. That is, it soon becomes impractical to extend the principle very far. Instead, it is believed to be much preferable to stick with the securing of two sheafs at a time and then repeating the process for successive sheafs. That is, a first clip 10 is used to secure together but yet keep separate the first two sheafs of papers. A second clip 10 is then used to secure but yet keep separate a third sheaf which respect the second sheaf. Then, the third sheaf may be similarly secured to a fourth sheaf and so on.

As shown, the embodied version has all portions arranged in what might be called a straight line and planar incorporation. In the manner of the prior art discussed in the introduction, additional loops or convolutions could be included for facilitating a function of better friction with the held papers, increased facility of entry or increased assurance against undesired removal of a particular sheet of paper. Also, the different legs and loops may be re-arranged so as to lie atop one another. That may be better for the handling of rather thick sheafs, so as to prevent the paper clip from being bent out of proper shape, but it may not be as good for the handling of thinner packets. Like with the conventional paper clip, it is better to go with an overall larger size of clip to handle a thicker set of documents.

The embodiment illustrated accommodates all of these variations and yet may always achieve those functions with the use of a single, one-wire device. A user may extract one sheaf without bothering the other. As stated, many auxiliary features taught in the prior art may be readily incorporated into the disclosed device. As one example, a tab may be ensleeved over or otherwise affixed to any outwardly-facing loop for the purpose of serving as an indexing element.

While a particular embodiment of the invention has been shown and described, and other modifications and variations have been discussed, it will be obvious to those skilled in the art that changes and further modifications may be made without departing from the invention in its broader aspects. It is the aim in the appended claims to cover all such changes and modifications as fall within the true spirit and scope of that which is patentable.

I claim:

1. A paper clip, composed of a continuous length of wire multiply bent re-entrantly to define a plurality of loops, formed to comprise:

a first leg of said wire continuing in a first direction from one end of said wire a first distance;

a first re-entrant curved loop of said wire continuing from said first leg;

a second leg of said wire continuing from said first loop a second distance in a second direction opposite said first direction;

a second re-entrant curved loop of said wire continuing from said second leg;

a third leg of said wire continuing from said second loop a third distance in said first direction;

a third re-entrant curved loop of said wire continuing from said third leg;

a fourth leg of said wire continuing from said third loop a fourth distance in said second direction;

a fourth re-entrant curved loop of said wire continuing from said fourth leg;

a fifth leg of said wire continuing from said fourth loop a fifth distance in said first direction;

a fifth re-entrant curved loop of said wire continuing from said fifth leg;

a sixth leg of said wire continuing from said fifth loop a sixth distance in said second direction;

said second distance being greater than said first distance, said third distance being less than said second distance, said fourth distance being less than said third distance, said fifth distance being less than said fourth distance, and said sixth distance being less than said fifth distance.

2. A paper clip as defined in claim 1 in which, as viewed in a direction transverse to said first and second directions, said fifth and sixth legs are nested within said third and fourth legs and said third and fourth legs are nested within said first and second legs.

3. A paper clip as defined in claim 1 or 2 in which said fourth and fifth loops are nested within said second and third loops and said third loop is nested between said first and fifth loops.

4. A paper clip as defined in claim 1 or 2 in which, with said paper clip free of engagement with paper, all of said legs and all of said loops reside in a common plane.

5. A paper clip as defined in claim 1 in which said sixth leg terminates in the other end of said wire.

6. A paper clip as defined in claim 1 or 2 in which all of said legs are parallel to one another.

7. A paper clip as defined in claim 1 or 2 in which said first, third, and fifth loops mutually are approximately concentric and in which said second and fourth loops mutually also are approximately concentric.

* * * * *